US005353325A

United States Patent [19]

Ueda et al.

[11] Patent Number: 5,353,325

[45] Date of Patent: Oct. 4, 1994

[54] X-RAY FLUOROGRAPH AND RADIOGRAPH APPARATUS FOR OBTAINING X-RAY IMAGE HAVING HIGH X-RAY LATITUDE

[75] Inventors: Ken Ueda, Ome; Hisatake Yokouchi, Tokyo; Keiji Umetani, Hino; Yoichi Onodera, Hachioji, all of Japan

[73] Assignee: Hitachi Medical Corporation, Tokyo, Japan

[21] Appl. No.: 983,058

[22] Filed: Nov. 30, 1992

[30] Foreign Application Priority Data

Nov. 29, 1991 [JP] Japan ..... 3-315770

[51] Int. Cl.[5] ..... H05G 1/64

[52] U.S. Cl. ..... 378/98.2; 378/91

[58] Field of Search ..... 378/99, 98.2; 358/111

[56] References Cited

U.S. PATENT DOCUMENTS 4,549,205 10/1985 Grady ..... 358/111

5,023,896 6/1991 Yokouchi et al. ..... 378/99

*Primary Examiner*—Craig E. Church

*Attorney, Agent, or Firm*—Antonelli, Terry, Stout & Kraus

[57] ABSTRACT

An X-ray fluorograph and radiograph apparatus including an X-ray television camera having an avalanche multiplication operation type image pick-up tube having an input/output characteristic in which increment of an output reduces gradually against increase of dose of incident X-rays and a unit for setting X-ray latitude and a multiplication factor of an image pick-up tube to optimum values for inputted radiograph conditions by controlling a voltage value applied to the image pick-up tube and a value of a stop of an optical system, and making it possible to obtain X-ray latitude at 1,000 or more.

9 Claims, 4 Drawing Sheets

X-RAY FLUOROGRAPH AND RADIOGRAPH APPARATUS FOR OBTAINING X-RAY IMAGE HAVING HIGH X-RAY LATITUDE

BACKGROUND OF THE INVENTION

The present invention relates to an X-ray fluorograph and radiograph apparatus which is highly sensitive and capable of obtaining an X-ray image having a high X-ray latitude.

Conventionally, there is an X-ray radiograph apparatus or an X-ray fluorograph apparatus including an X-ray television camera as a detector as means for observing or radiographing an X-ray transmission image in real time. These apparatus utilize an X-ray image intensifier as means for converting X-rays into visible light, and form a converted visible radiation image on an image pick-up element by means of an optical lens system so as to radiograph the image with a television camera.

According to the X-ray television camera apparatus described above, it is possible to fluorograph or radiograph an X-ray transmission image as an animation image, and to improve diagnostic ability by image processing of digital radiography, e.g., contrast enhancement and edge enhancement. Thus, the television camera apparatus is widely used as an X-ray diagnostic apparatus.

Further, an image pick-up tube and a CCD device are generally used as an image pick-up element of a television camera, but a method using an image pick-up tube for performing an avalanche multiplication operation as an image pick-up element has also been proposed as disclosed in the U.S. Pat. No. 5,023,896. This method makes X-ray fluorograph and radiograph possible under a condition of small dose of X-rays by increasing light receiving sensitivity utilizing the effect of the multiplication operation for the incident light intensity to an image pick-up tube.

An X-ray television camera has such a problem that a dynamic range is small as compared with an X-ray film and a photo stimulable fluorescent material, which results in a narrow range of the intensity of X-rays capable of radiographing. An X-ray latitude is used as a parameter expressing a range of the intensity of X-rays capable of radiographing. This X-ray latitude is defined by a ratio of the maximum value to the minimum value of the dose of X-rays capable of radiographing.

In case the X-ray latitude is low, the range of X-ray intensity capable of imaging is narrow, and signal output is too small to be detected in a region where the intensity of X-rays incident to a detector is low, i.e., a region where X-ray absorption by an object is high. On the other hand, such a problem is caused that a signal output is saturated and imaging cannot be performed in a region where the intensity of X-rays incident to a detector is high, i.e., a region where the X-ray absorption of an object is low.

A first cause of why the latitude of an X-ray television camera is lower as compared with an X-ray film and a photo stimulable fluorescent material has its source in that the latitude of an image pick-up tube of a television camera is low. The latitude of an X-ray image intensifier is sufficiently high as compared with the latitude of an image pick-up tube. The cause of why the latitude of an image pick-up tube is low has its source in that a ratio of the maximum signal current to the minimum signal current of the image pick-up tube, i.e., a dynamic range thereof is small, and an output current value of the image pick-up tube is in proportion to the incident light intensity. Therefore, the intensity range of the X-rays used for radiographing only moves in a direction of lower intensity, and the latitude of X-ray radiographing is not increased, and the picture quality of X-ray radiographing is neither improved only by improving the sensitivity of an image pick-up tube so as to lower the minimum value of a detectable quantity of light.

SUMMARY OF THE INVENTION

The present invention has been made in view of the above-described circumstances, and has an object to provide an X-ray fluorograph and radiograph apparatus for solving problems such as described above in conventional techniques, improving the sensitivity of X-ray radiograph remarkably and also increasing the X-ray latitude so as to enlarge the range of the intensity of X-rays capable of radiographing remarkably, thus making it possible to improve a picture quality of an X-ray television camera with a leap.

The principle of the present invention will be described hereinafter with reference to FIG. 1.

In an X-ray television camera, the X-ray latitude is limited by the latitude of an image pick-up tube of the television camera.

In an image pick-up tube, the maximum value of the dose of the X-rays capable of radiographing is the dose of X-rays when the output of the image pick-up tube becomes the maximum signal current value. On the other hand, the minimum value of the dose of X-rays capable of radiographing is the dose of X-rays when the output of the image pick-up tube becomes equivalent to a noise level.

One of the measures for increasing the X-ray latitude is to reduce the noise level of the image pick-up tube. In the present invention, however, increase of the X-ray latitude is aimed at under the same conditions with respect to the noise level.

In the present invention, the sensitivity of the image pick-up tube is first increased, thereby to lower the minimum value of the dose of X-rays capable of radiographing, In order to improve the sensitivity of an image pick-up tube, a sensitivity improvement factor is controlled by producing a photoconductive body of an image pick-up tube with a material capable of avalanche multiplication operation like an amorphous selenium film and adjusting the film thickness and the applied voltage. As the ratio of the applied voltage to the film thickness is made larger, the sensitivity is increased. When the sensitivity is improved, the input/output characteristic of the image pick-up tube changes from (1) to (2) in FIG. 1. However, the latitude is not increased only with such a change.

Next, as shown by an input/output characteristic at (3), a moderate decrease of an increment of an output current for the increase of the incident light intensity along with the increase of the incident light intensity can be achieved by adjusting the film thickness and the applied voltage. The larger the ratio of the applied voltage to the film thickness is made, the more conspicuous the decrease described above becomes.

With this, the maximum value of the dose of X-rays capable of radiographing can be increased. As a result, it is possible to increase the latitude of X-rays.

Further, the maximum signal current is increased by enlarging the size of a picture image storage face of the image pick-up tube. With this, the X-ray latitude can be increased further as shown at (4).

In an X-ray fluorograph and radiograph apparatus according to the present invention, an avalanche multiplication operation type image pick-up tube is used as an image pick-up tube of an X-ray television camera, and the multiplication factor of the image pick-up tube is controlled based on the principle described above.

The film thickness of the image pick-up tube and the size of the film face scanned by an electron beam for read operation is designed at a predetermined value. Besides, the maximum signal current of an image pick-up tube is limited by a maximum valve (beam current) of a current which can be obtained from the image pick-up tube, and is one of the factors for determining the X-ray latitude. Accordingly, this beam current is set to a sufficiently large value against charge storage quantity on the film face.

In practical fluorograph and radiograph, the increment of the output current value on the unit increment of the input light intensity is controlled so as to reduce gently against the increase of the input light intensity by adjusting the applied voltage to the image pick-up tube. Further, the range of the dose of X-rays capable of radiographing is controlled by moving the whole input-/output characteristics to a large dose side or moving the same to a small dose side by adjusting quantity of light incident to the image pick-up tube by means of a stop inserted in the optical system.

With such a configuration according to the present invention, an X-ray image which reflects the X-ray absorption factor of an object faithfully is obtainable.

Since an avalanche operation type image pick-up tube is used in the present invention, it is not required to amplify an image pick-up element signal current by using an amplifier. Thus, it is possible to set a S/N ratio high from the beginning as compared with a case of amplification using an amplifier, and a problem that noises of the amplifier are mixed is neither caused.

Furthermore, according to the present invention, it is also possible to use a plurality of image pick-up tubes having different input/output characteristics by selecting them in accordance with the object.

A table for converting a signal obtained by non-linear input/output characteristic into a linear input/output characteristic is prepared in an image processing unit, and the image is corrected by referring to this table and is displayed.

As described in detail above, according to the present invention, such remarkable effects that the picture quality of an X-ray television camera can be improved with a leap and the S/N ratio of the X-ray image obtainable when quantity of light incident to the television camera is small and the X-ray image obtainable with small dose of X-rays can be improved by improving the sensitivity of an X-ray television camera remarkably and also enlarging the range of the X-ray intensity capable of radiographing remarkably are produced.

As another effect of the present invention, it is possible to decrease the quantity of X-rays used for radiographing. Namely, there is a usage for reducing the dose of X-rays and allowing increase of X-ray quantum noises by utilizing S/N improvement effect when the avalanche multiplication factor is increased. As the effects thereof, reduction of exposure to an object to be inspected and to an operator who takes care of the object, lengthening of life by reduction of a load of an X-ray tube, high resolution of a system obtained through utilization of an X-ray tube generating low output but having a small focal point size and the like may be mentioned.

DESCRIPTION OF THE PREFERRED EMBODIMENTS

Embodiments of the present invention will be described in detail hereinafter with reference to the drawings.

Figure 1:
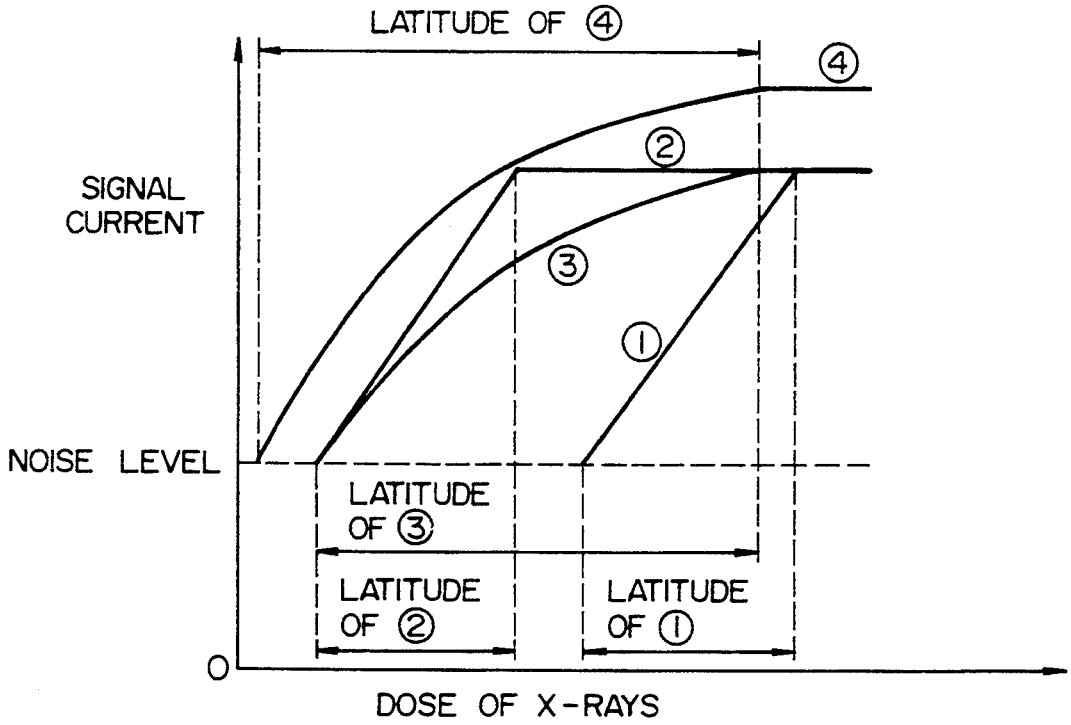
FIG. 1 is a diagram for explaining a principle of the present invention.
Figure 2:
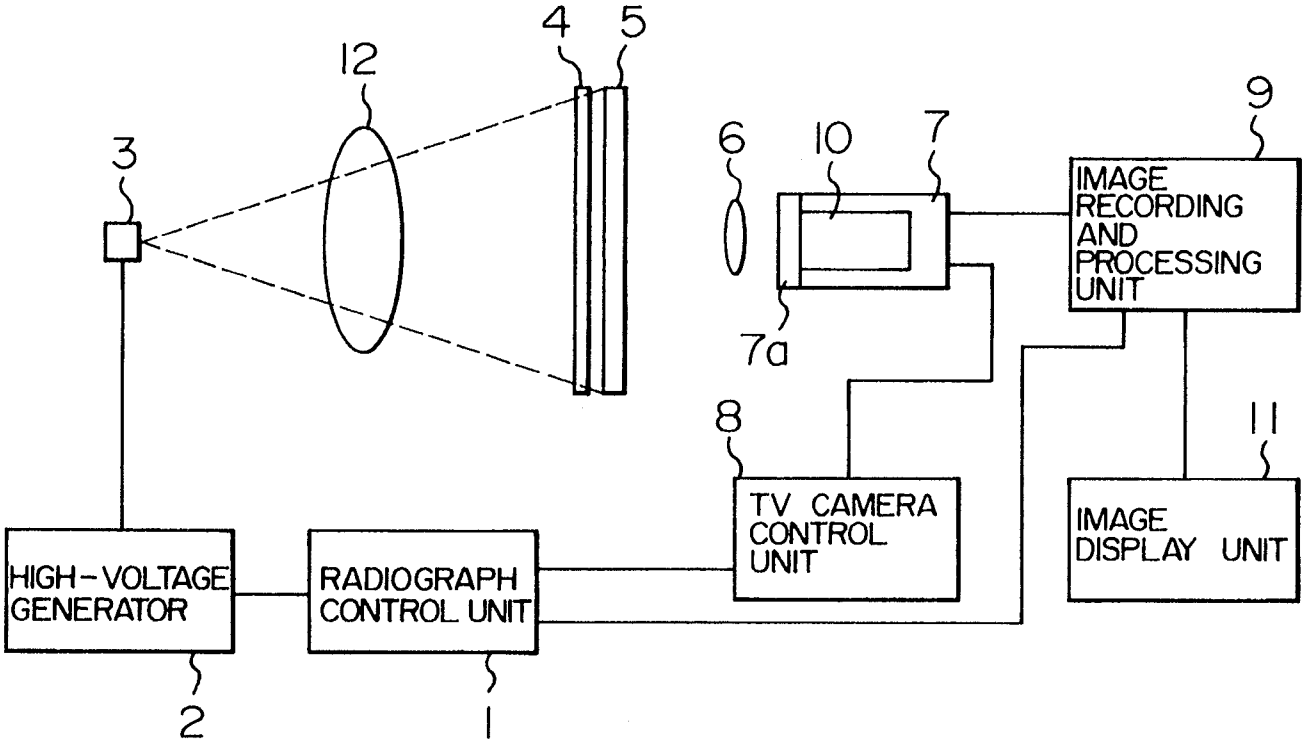
FIG. 2 is a block diagram of a digital X-ray radiograph apparatus using a fluorescent screen showing an embodiment according to the present invention.

FIG. 2 shows an embodiment of the present invention. The present apparatus is composed of a radiograph control unit 1, a high voltage generator 2 for an X-ray tube, an X-ray tube 3, an X-ray grid 4, an X-ray fluorescent screen 5, an optical lens system 6, a television camera 7, a control unit 8 for the television camera 7 and a picture image recording and processing unit 9. An image pick-up element of the television camera 7 is an avalanche operation type image pick-up tube 10, and an incident face thereof is made of an amorphous selenium photoconductor. In the control unit 8 of the television camera 7, a unit for inputting desired X-ray sensitivity or X-ray latitude value and a unit for selecting optimum setting condition of the avalanche multiplication factor of the image pick-up element 10 and a stop *7a* of the optical system of the X-ray television camera corresponding to the input are provided in addition to normal signal processing function. In addition to this, an image display unit 11 is provided.

The outline of functions of respective parts described above is as follows.

A predetermined high voltage (high voltage for an X-ray tube), tube current and pulse width, and radiographing sequence are stipulated by the radiograph control unit 1, voltage and current in accordance with the stipulation are generated by the high voltage generator 2 for an X-ray tube, and X-rays are generated by the X-ray tube 3. The X-rays which have transmitted through an object 12 is incident to the square X-ray fluorescent screen 5 having a side 40 cm long after screening scattered X-rays by the X-ray grid 4 so as to attenuate the scattered X-rays. An X-ray image projected on the X-ray fluorescent screen 5 is converted into a visible radiation image by the function of the X-ray fluorescent screen 5. The optical lens system 6 forms the visible radiation image on the television camera 7. In the present embodiment, an F-number of the optical system is adjustable by the stop *7a* described above.

The avalanche multiplication type image pick-up tube 10 in the television camera 7 can set the avalanche multiplication factor to a predetermnined value in accordance with the object by setting target voltage. This setting operation is performed by means of an input unit of the X-ray sensitivity or the X-ray latitude value and an optimum imaging condition selector in the control unit 8 described above. The television camera 7 converts an image into a video signal, and performs A-D conversion, storage into a memory, data processing and image processing by the image recording and processing unit 9. The image is displayed on the image display unit 11.

The input unit of X-ray sensitivity or X-ray latitude value and the optimum imaging selector in the control unit 8 described above will be described in detail hereinafter.

First, the input unit of X-ray sensitivity or X-ray latitude value is composed of an input section such as a keyboard and a display section of input information. For example, the input is received by the radiograph control unit 1 at time of starting X-ray radiograph and so on.

Figure 3:
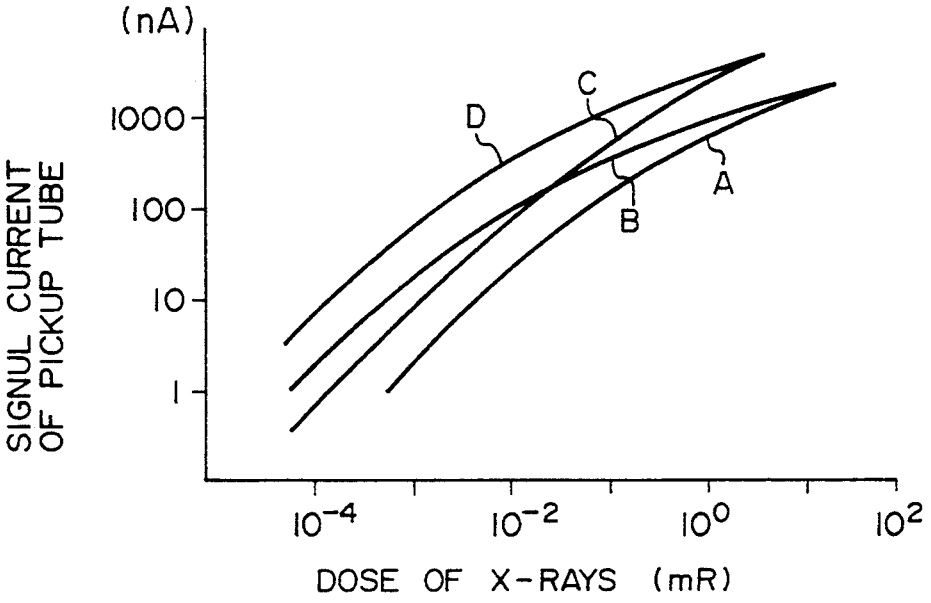
FIG. 3 is a diagram showing the relationship between dose of X-rays and an image pick-up tube signal current in an embodiment.
Figure 4:
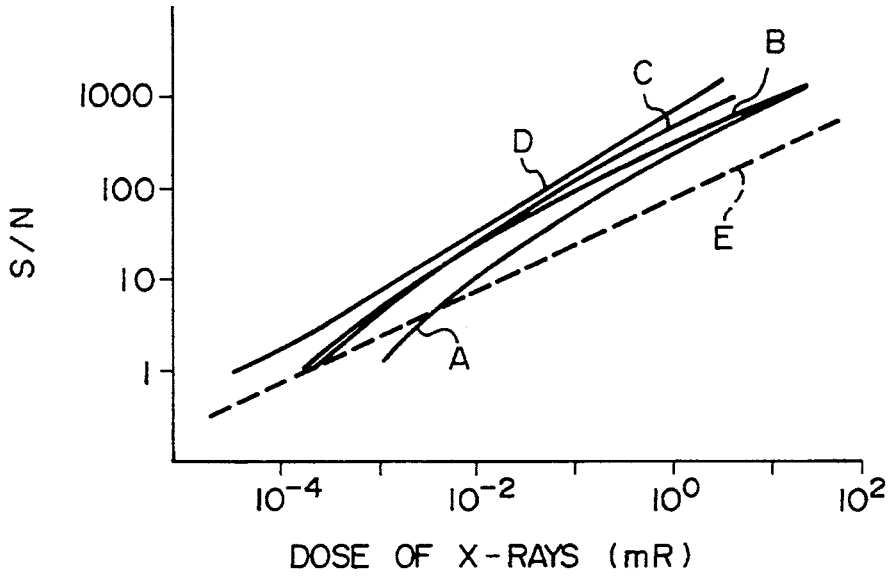
FIG. 4 is a diagram showing the relationship between dose of X-rays and S/N ratio.

Further, the optimum imaging condition selector is a unit for automatically selecting what is optimum to the case out of a combination of target voltage values and stop values of the optical system for setting a plurality of avalanche multiplication factors stored in a memory beforehand as a table when an operator inputs X-ray sensitivity, e.g., a dose value of X-rays which gives S/N=1, and an X-ray latitude value under a predetermined condition based on the information related to various characteristics described with reference to FIGS. 3 and 4. These processes are controlled and executed by a CPU in the control unit 8.

FIG. 3 shows the relationship between the dose of X-rays and the signal current value of the avalanche multiplication type image pick-up tube with the size of the image pick-up tube and the avalanche multiplication factor as parameters, respectively, in case the stop of the optical system is adjusted so that the F-number shows 0.6, and 2,000 lines are scanned in the television camera at a rate of 3.75 frames per second in the embodiment shown in FIG. 2.

A curve A in FIG. 3 shows a characteristic when the amorphous selenium photoconductor of the image pickup tube has a film thickness of 6 μ and the electron beam scanning area has a rectangular form having a side 15 mm long, and target voltage at 685 V is applied so as to have the image pick-up tube operate at an avalanche multiplication factor of 30.

A curve B shows a characteristic when the film thickness of the image pick-up tube is 20 μm and the electron beam scanning area has a rectangular form having a side 15 mm long, and target voltage at 2071 V is applied so as to have the image pick-up tube operate at an avalanche multiplication factor of 300.

A curve C shows a characteristic when the film thickness of the image pick-up tube is 6 μm and the electron beam scanning area has a rectangular form having a side 30 mm long, and target voltage at 685 V is applied so as to have the image pick-up tube operate at an avalanche multiplication factor of 30.

A curve D shows a characteristic when the film thickness of the image pick-up tube is 20 μm and the electron beam scanning area has a rectangular form having a side 30 mm long, and target voltage at 2071 V is applied so as to have the image pick-up tube operate at an avalanche multiplication factor of 300. The beam current stipulating the maximum value of the output signal current is always at 2.5 μA for the image pick-up tubes A, B, C and D.

Illustration is omitted, but, when the applied voltage is increased, gradient of respective curves becomes smaller. For example, the curve A takes a form like the curve B. In FIG. 3, when the stop of the optical system is changed, the configuration of the curve does not change, but only the position thereof moves to the left when the stop is opened and moves to the right when the stop is made smaller. In the present embodiment, input/output characteristic corresponding to desired X-ray sensitivity or X-ray latitude value becomes selectable by performing selecting operation of the stop value in addition to image pick-up tubes having different film thickness and values of target voltage applied thereto.

FIG. 4 shows S/N ratios of respective image pick-up tubes under the conditions shogun in FIG. 3. A broken line E indicates a S/N ratio by X-ray quantum noises determining the S/N ratio of the whole system. X-ray quantum noise becomes conspicuous when the X-ray intensity is very low. A television camera having an S/N ratio higher than the S/N ratio by the X-ray quantum noises is normally used.

The latitude is evaluated from FIG. 3 and FIG. 4 as described hereunder.

The practical maximum value of the signal current along the curve A is at a value of 600 nA when the dose of X-rays incident to the fluorescent screen is 1.3 mR per frame. On the other hand, if it is assumed that a signal current when the S/N ratio of the television camera is 1 is the minimum current, the minimum current becomes 2 nA when the dose of X-rays is 1 μR per frame. The dynamic range is 600 nA/2 nA=300, but the X-ray latitude at this time is 1.3 mR/1 μR=1,300. In a conventional television camera, the X-ray latitude becomes 300 which is the same value as the dynamic range. Accordingly, the X-ray latitude at 1,300 may safely be said to be a very large value as compared with the X-ray latitude of a conventional television camera.

Further, the practical maximum value of the signal current along the curve B is at 600 nA when the dose of X-rays incident to the fluorescent screen is 700 μR per frame. On the other hand, the value of a signal current when the S/N ratio of the television camera becomes 1 is 3 nA when the dose of X-rays is 0.17 μR per frame, and the dynamic range is 600 nA/3 nA=200. The X-ray latitude at this time can attain 700 μR/0.17 μR, which is approximately 4,000.

The practical maximum value of the signal current along the curve C is at 2,400 nA when the dose of X-rays incident to the fluorescent screen is 1.3 mR per frame. A dark current of the television camera is at 4 nA, and this value corresponds to that of a signal current when the dose of X-rays is 0.7 μR per frame. Besides, the value of the signal current when the S/N ratio of the television camera becomes 1 is 2 nA when the dose of X-rays is 0.33 μR per frame.

In general, when a dark current is bigger than a signal current when a S/N ratio becomes 1, the signal current bigger than the dark current is handled as a normal signal current. Thus, the minimum value of the signal current becomes the same value as the dark current in this case. With this, the dynamic range becomes 2,400 nA/4 nA=600. On the other hand, the X-ray latitude becomes 1.3 mR/0.7 μR, which is approximately 2,000.

Further, the practical maximum value of a signal current along the curve D is at 2,400 nA when the dose of X-rays incident to the fluorescent screen is 700 μR per frame, and the dark current of the television camera is at 4 nA, and this value corresponds to a signal current when the dose of X-rays is 0.07 μR per frame. Besides, the signal current when the S/N ratio of the television camera becomes 1 shows 2 nA when the dose of X-rays is 0.033 μR per frame, and the dark current is bigger than the signal current. Thus, the dynamic range becomes 2,400 nA/4 nA=600 in this case, and the X-ray latitude becomes 700 μR/0.07 μR=10,000.

As described above, it is possible to obtain a large latitude for the dynamic range by appropriately setting a beam current, target voltage and film face scanning size for an avalanche multiplication type image pick-up tube, respectively. As shown in FIG. 3, the increase effect of the latitude becomes bigger as the avalanche multiplication factor is increased. It is desirable to make the avalanche multiplication factor 10 times or more for practical purposes.

Further, the larger the size of an area where image read scanning is performed by means of an electron beam is formed, the bigger the maximum signal current of the image pick-up tube becomes. As a result, the dynamic range is increased and the latitude is also increased. Thus, it is desirable that the read area is large. It is desirable practically that the area is a rectangle having a side 12 mm long or more.

In the embodiment described above, functions for storing an output video signal of an X-ray television camera apparatus in a digital value and displaying the video signal after image processing are provided, and a unit for processing with correction of non-linearity of sensitivity characteristic of the image pick-up tube is included in the picture image recording and processing unit 9, and it is possible to have a value of an image be proportional to the intensity of X-rays which have transmitted through the object 12. This processing is effective as preprocessing for operation processing between images such as time difference processing and energy difference processing.

Further, an apparatus shown in the present embodiment has a fluorograph function for displaying an output video signal thereof or a video signal applied with signal processing in real time.

Since the X-ray image obtained by an X-ray fluorograph and radiograph apparatus according to the present invention reflects the X-ray absorption factor of an object faithfully, it is possible to make the most of image processing functions of a digital X-ray apparatus (a digital radiograph apparatus) such as edge exaggeration processing and level window processing. As a result, an image which is faithful to an object and contributes to improvement of diagnostic ability is obtainable.

As an application of the embodiment described above, it can be used preferably as a chest X-ray photofluorographic apparatus by forming the X-ray fluorescent screen 5 into a rectangular shape having a side approximately 40 cm long and increasing the avalanche multiplication factor of the image pick-up tube to 30 times or more.

Further, this embodiment may be used suitably as a mammograph X-ray radiograph apparatus which is able to radiograph the whole object efficiently in a small visual field by forming the X-ray fluorescent screen 5 into a rectangular form having a side approximately 20 cm long and increasing the avalanche multiplication factor of the image pick-up tube to 10 times or more.

Figure 5:
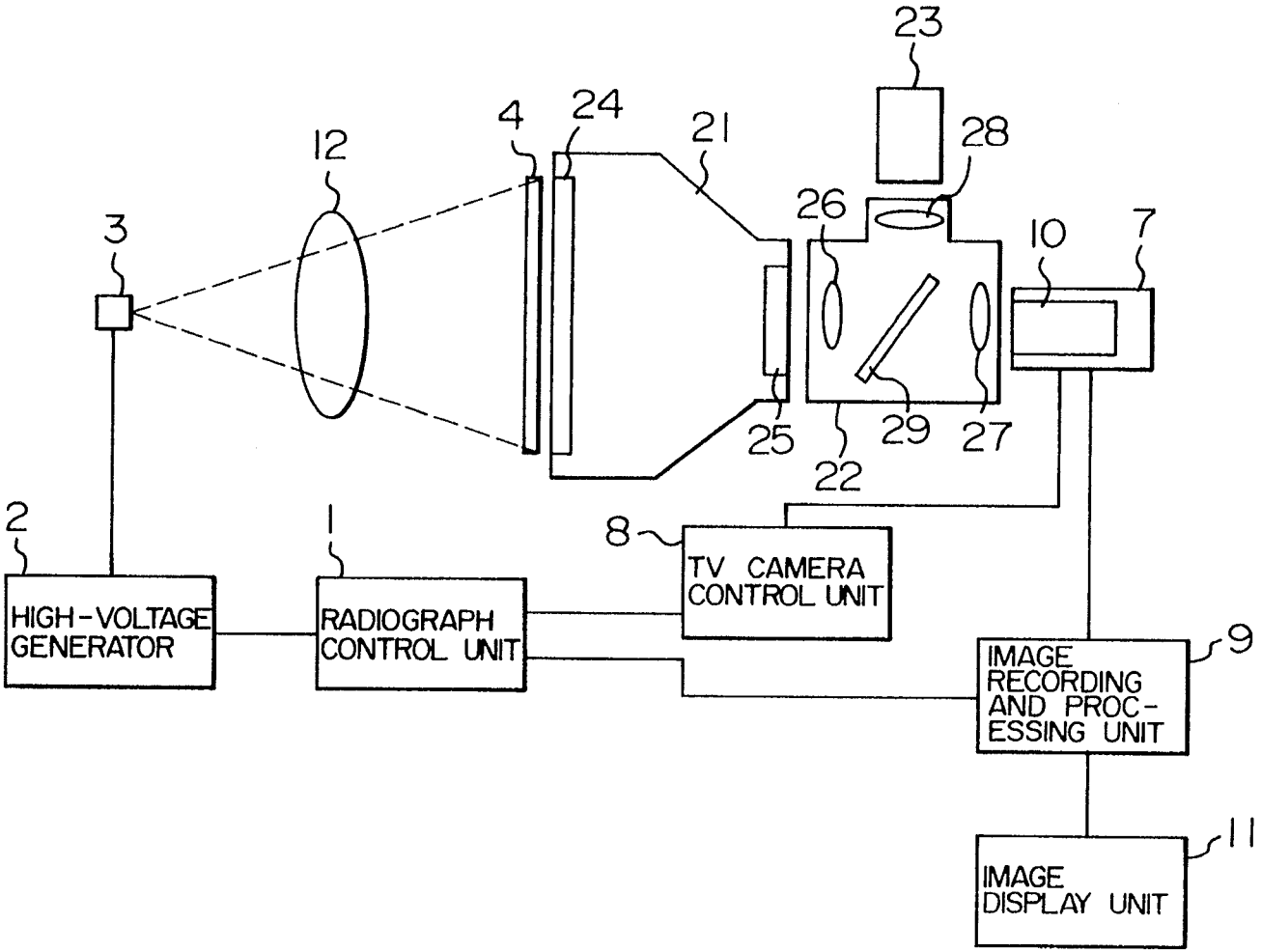
FIG. 5 is a block diagram of a digital X-ray radiograph apparatus using an X-ray image intensifier showing another embodiment according to the present invention.

FIG. 5 is a block diagram showing another embodiment of the present invention. An X-ray generation system is composed of a radiograph control unit 1, a high voltage generator 2 for an X-ray tube and an X-ray tube 3 similarly to FIG. 2. Further, an X-ray image detection system is composed of an X-ray grid 4, an X-ray image intensifier 21, an optical distributor 22, a television camera 7, a cine camera 23, an image recording and processing unit 9 and an image display unit 11. An image pick-up element 10 of the television camera 7 is an avalanche operation type image pick-up tube.

The X-rays which have transmitted through an object 12 are incident to the X-ray image intensifier 21 after screening scattered X-rays so as to attenuate them by means of the X-ray grid 4. An X-ray image projected onto an input fluorescent screen 24 of the image intensifier 21 is converted into a visual radiation image on an output fluorescent screen 25 by the function of the X-ray image intensifier 21.

In the X-ray image intensifier 21 shown in the present embodiment, the size of the output screen is made to have a diameter of 60 mm. A combination of a lens 26 and a lens 27 and a combination of a lens 26 and a lens 28 in the optical distributor 22 constitute tandem lenses, respectively, and 90% of the quantity of light is introduced to the cine camera 23 and the remaining quantity of light (10%) is introduced to the television camera 7 by means of a half mirror 29 disposed therebetween to be placed at the service of radiographing.

The avalanche multiplication factor of the avalanche multiplication type image pick-up tube 10 of the television camera 7 can be set optionally within the range of 3 to 30 times by setting target voltage, but the multiplication factor of a typical use example is 10 times or more. The cine camera 23 records an animation image on a cine film. The television camera 7 converts an image into a video signal, and performs A-D conversion, storage in a memory, data processing and image processing by means of the image recording and processing unit 9. The image is displayed on the picture image display unit 11.

A typical use example of an apparatus shown in the present embodiment is a diagnosis of blood vessels of a heart. As a method for recording a contrast animation image of a cardiac blood vessel system, a method for recording on a cine film using a cine camera has been heretofore put to practical use. In a conventional television camera, the picture quality has been insufficient with the quantity of light at 10%, but it is possible to record a substitute image in the cine camera and to further increase the ability as a diagnostic unit by image processing because of high sensitivity in the X-ray television camera of the present apparatus. However, the cine camera system is popularized since observation can be made inexpensively and simply using a projector, and joint use of a cine camera and a television camera is desired for a radiograph apparatus. Therefore, the present embodiment has high practicability.

An avalanche multiplication type image pick-up tube is used as an image pick-up element in the present embodiment, but any image pick-up element having a characteristic in which the increment of an output current for the increase of the incident light intensity reduces moderately with the increase of the incident light intensity may be utilized as an image pick-up element of an X-ray fluorograph and radiograph apparatus of the present invention.

Further, such a configuration that a plurality of image pick-up elements having different input/output characteristics and an image pick-up element having an optimum input/output characteristic is selected in accordance with an object may also be adopted.

I claim:

1. An X-ray fluorograph and radiograph apparatus comprising:

(a) an X-ray generator;

(b) a means for controlling generation of X-rays;

(c) a means for converting an X-ray image into a light image;

(d) a television camera including an avalanche multiplication operation type image pick-up tube, and having a non-linear input/output relation in which an increment of an output with respect to an increment of an input of light intensity is controlled so as to reduce gradually with an increasing input light intensity, and having said light image inputted thereto;

(e) a means for setting a radiograph condition; and (f) a means for controlling said input/output relation of said image pick-up tube on a basis of a set radiographic condition.

2. An X-ray fluorograph and radiograph apparatus according to claim 1, wherein said image pick-up tube has a film having an area where image read scanning is made by an electron beam which is formed in a rectangular shape of a size having a side 12 mm long or more and made of an amorphous selenium photoconductor.

3. An X-ray fluorograph and radiograph apparatus according to claim 1, wherein said means for setting a radiograph condition includes:

a means for inputting an X-ray sensitivity and X-ray latitude value; and a means for selecting a voltage value applied to said image pick-up tube and a stop value of an optical system at optimum values based on said radiograph condition; and said means for controlling said input/output relation includes a means for controlling a multiplication factor of said image pick-up tube.

4. An X-ray fluorograph and radiograph apparatus according to claim 3, wherein said means for controlling said multiplication factor comprises:

a means for controlling said multiplication factor by varying a voltage applied to said image pick-up tube; and a means for controlling said multiplication factor by controlling an increase and decrease of a light amount inputted to said image pick-up tube by said stop value.

5. An X-ray fluorograph and radiograph apparatus according to claim 4, wherein said image pick-up tube has a multiplication factor of 10 or higher.

6. An X-ray fluorograph and radiograph apparatus according to claim 1, further comprising a means for displaying an image obtained by said television camera in real time.

7. An X-ray fluorograph and radiograph apparatus according to claim 1, wherein said means for setting a radiographic condition includes:

a means for controlling a multiplication factor of said image pick-up tube by controlling an increase and decrease of light amount inputted to said image pick-up tube by by said stop value.

8. An X-ray fluorograph and radiograph apparatus according to claim 1, wherein said means for setting a radiographic condition includes:

a means for controlling a multiplication factor of said image pick-up tube by varying a voltage applied to said image pick-up tube.

9. An X-ray fluorograph and radiograph apparatus according to claim 1, further comprising a means for converting an output signal of said image pick-up element into a signal having linear input/output relationship.

* * * * *